US008987961B2

(12) United States Patent
Cusano

(10) Patent No.: US 8,987,961 B2
(45) Date of Patent: Mar. 24, 2015

(54) MOTOR ASSEMBLY FOR AN ELECTRIC FAN

(71) Applicant: Johnson Electric S.A., Murten (CH)

(72) Inventor: Michele Cusano, Asti (IT)

(73) Assignee: Johnson Electric S.A., Murten (CH)

( * ) Notice: Subject to any disclaimer, the term of this patent is extended or adjusted under 35 U.S.C. 154(b) by 273 days.

(21) Appl. No.: 13/724,321

(22) Filed: Dec. 21, 2012

(65) Prior Publication Data

US 2013/0164159 A1 Jun. 27, 2013

(30) Foreign Application Priority Data

Dec. 23, 2011 (IT) ..... TO201100152 U

(51) Int. Cl.
*H02K 5/00* (2006.01)
*F04D 29/00* (2006.01)
*F04D 29/60* (2006.01)

(52) U.S. Cl.
CPC ..... *F04D 29/00* (2013.01); *F04D 29/601* (2013.01)
USPC ..... 310/91; 310/67 R

(58) Field of Classification Search
USPC ..... 310/89, 91, 67 R; 417/410.1, 423.8
See application file for complete search history.

(56) References Cited

U.S. PATENT DOCUMENTS

| | | | | |
|---|---|---|---|---|
| 6,031,306 | A * | 2/2000 | Permuy | 310/67 R |
| 6,384,494 | B1 * | 5/2002 | Avidano et al. | 310/58 |
| 2005/0093387 | A1 * | 5/2005 | Chen et al. | 310/91 |
| 2008/0084140 | A1 * | 4/2008 | Kim | 310/67 R |

* cited by examiner

*Primary Examiner* — Hanh Nguyen
(74) *Attorney, Agent, or Firm* — Muncy, Geissler, Olds & Lowe, P.C.

(57) ABSTRACT

A motor assembly for a fan for a radiator of a motor vehicle, has an electric motor with a stator and an outer rotor driving an impeller. A support connected to the stator has a plurality of arms for fixing to a carrier structure. A casing includes a basin-like container and a heat dissipater forming a cover for the container. The casing contains a circuit board carrying components of a control circuit connected to the motor. The container has retention attachments engaged in a snap-fitting manner in snap seats provided in the arms of the support in order to bring about relative prepositioning of the container with respect to the support before the heat dissipater is fixed to the support.

5 Claims, 5 Drawing Sheets

MOTOR ASSEMBLY FOR AN ELECTRIC FAN

CROSS REFERENCE TO RELATED APPLICATIONS

This non-provisional patent application claims priority under 35 U.S.C. §119(a) from Patent Application No. TO2011U000152 filed in Italy on Dec. 23, 2012.

FIELD OF THE INVENTION

This invention relates to a motor assembly for a fan associated with a heat exchanger, in particular a radiator for a vehicle.

BACKGROUND OF THE INVENTION

More specifically, the invention relates to a motor assembly comprising: an electric motor; a support, preferably a metal support, which is connected to a stator of the motor and which has a plurality of arms which project radially outwards beyond the motor, for fixing to a carrier structure; and a casing which includes a basin-like container which is provided adjacent to the support at the opposite side to the motor and in which at least one board which carries components of a control circuit which is connected to the motor is received, and a heat dissipation member which closes the container and which has a plurality of external attachments for fixing to the arms of the above-mentioned support.

Motor assemblies of that type according to the prior art involve the problem of constructing, during assembly, a stable prepositioning arrangement of the basin-like container in relation to the support for fixing to the carrier structure. To that end, it is known to use a screw type fixing system. However, the use of screws is labor intensive and relatively expensive.

Hence there is a desire for an actuator assembly of the type set out above, in which the prepositioning of the basin-like container with respect to the above-mentioned support can be carried out in a simpler, faster and more economical manner.

SUMMARY OF THE INVENTION

Accordingly, in one aspect thereof, the present invention provides a motor assembly for a fan associated with a heat exchanger of a motor vehicle, comprising: an electric motor; a support connected to the stator of the motor and which has a plurality of arms which project radially outwards beyond the motor for fixing to a carrier structure; a casing which includes a basin-like container which is provided adjacent to the support at the side remote from the motor and in which at least one circuit board which carries components of a control circuit which is connected to the motor is received, and a heat dissipation member which closes the container and which has a plurality of external fixing attachments, wherein the basin-like container has a plurality of retention attachments which are engaged in a snap-fitting manner in corresponding snap seats provided in the arms of the support in order to bring about relative prepositioning of the basin-like container with respect to the support before the heat dissipater is fixed to the support.

Preferably, the basin-like container is of plastics material and the retention attachments thereof are constructed integrally with the container and each retention attachment has an end retention tooth.

Preferably, the external attachments for fixing the heat dissipater extend in the region of and towards the radially outer side of the retention attachments of the basin-like container so as to protect them.

Preferably, the support is a metal support.

Preferably, the distal end of each of the arms of the support has a boss for connection to the carrier structure, a threaded seat for mounting of the heat dissipater and a snap seat for engaging one of the retention attachments, and wherein the threaded seat and the snap seat are aligned in the radial direction with the snap seat being located radially inwards of the threaded seat.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
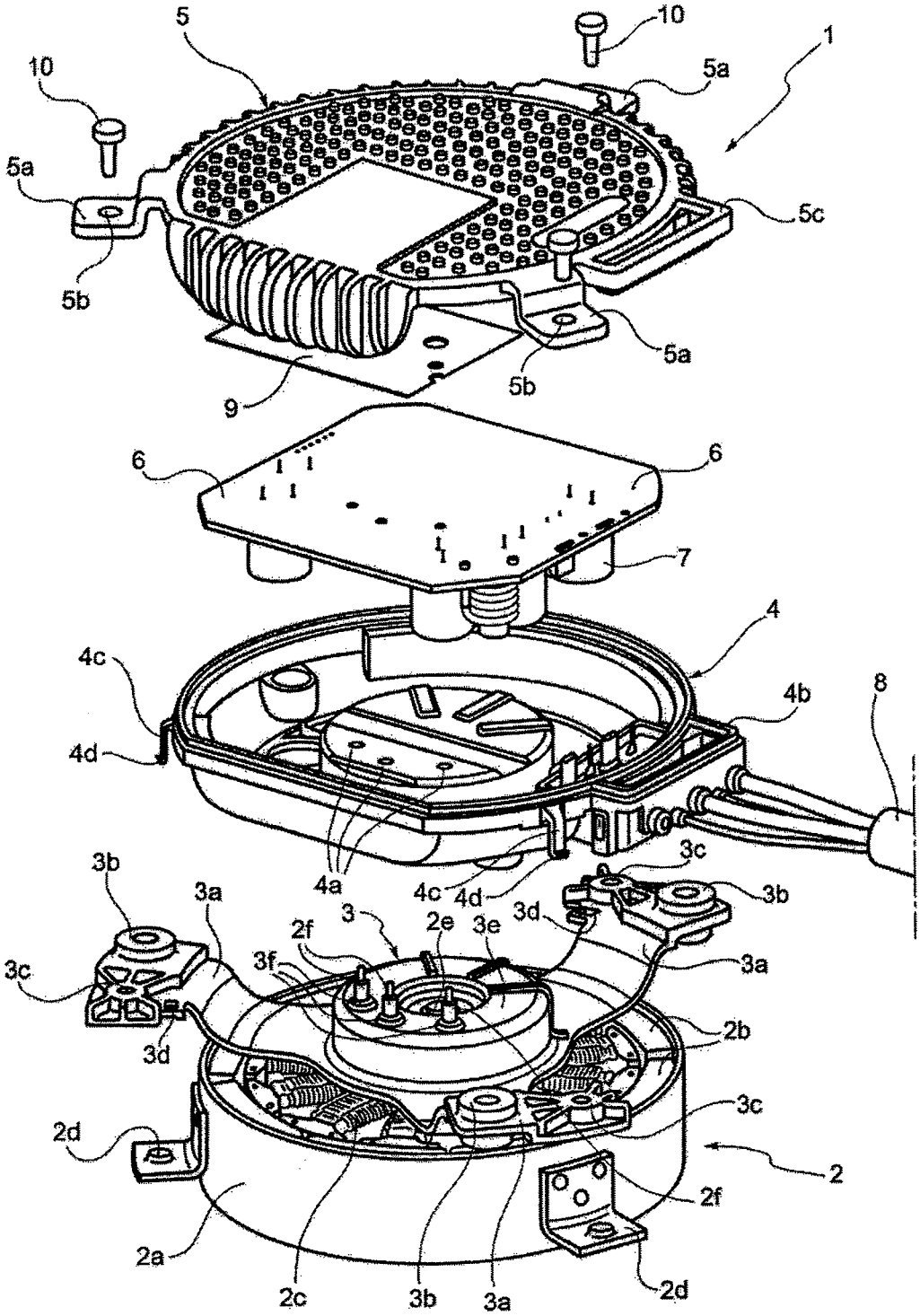
FIG. 1 is a partially exploded view of a motor assembly according to the preferred embodiment of the present invention.
Figure 2:
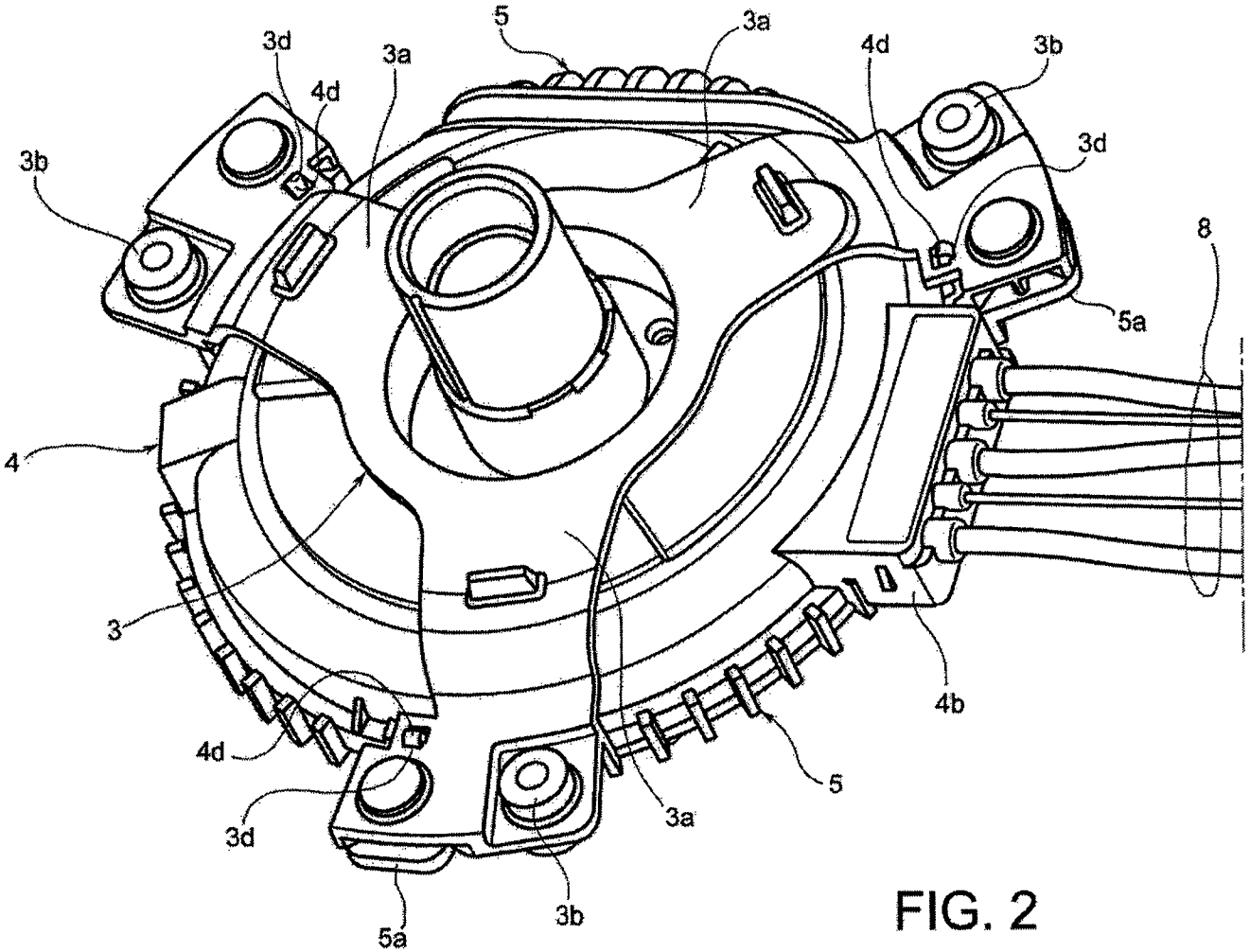
FIG. 2 shows a support and a casing of a control circuit in an assembled condition, being parts of the motor assembly of FIG. 1.

In FIG. 1, there is generally designated 1 motor assembly according to the preferred embodiment of the present invention for a fan associated with a heat exchanger, in particular a radiator, of a motor vehicle.

The motor assembly comprises an electric motor such as, for example, a brushless D.C. motor, which is generally designated 2. In the construction illustrated, the motor 2 comprises an external cylindrical rotor 2*a* which has a plurality of permanent magnets 2*b* and an internal stator 2*c* of the type involving wound poles. The rotor 2*a* has a plurality of peripheral brackets 2*d* for fixing to the hub of an impeller of a type known per se and not illustrated.

The rotor 2*a* has a shaft 2*e* which is mounted for rotation in a support which is generally designated 3 and which is integral with the stator 3*c*. The support preferably comprises a metal material, in particular aluminium, and has a plurality of arms 3*a* which project radially outwards beyond the periphery of the motor 2. The arms 3*a* at the distal ends thereof have bosses 3*b* with through holes therein for the passage of members for fixing the support to a carrier structure of a type known per se, respectively. The distal end of each arm 3*a* of the support 3 has a threaded seat 3*c*, disposed near the boss 3*b*, and, in the region thereof, a through-hole or snap seat 3*d*.

With reference to FIG. 1, the support 3 has a central portion 3*e* which is substantially annular and in which there are constructed three openings 3*f* through which the ends 2*f* of the windings of the stator 2*c* of the motor 2 extend.

The motor assembly 1 further comprises a casing which includes a basin-like container 4 and an associated closure member 5 which acts as a heat dissipater during operation.

The basin-like container 4 is advantageously constructed from moulded plastics material and receives therein a circuit board 6 which carries the components 7 of a control circuit which is connected to the motor 2.

In the bottom wall of the container 4 there are three openings 4*a,* through which the ends 2*f* of the motor 2 extend in order to be interconnected to the circuit carried by the circuit board 6.

The container 4 at one side forms a type of electrical connector 4*b* for connecting electrical conductors of a wire which is generally designated 8 in FIG. 1.

Figure 3:
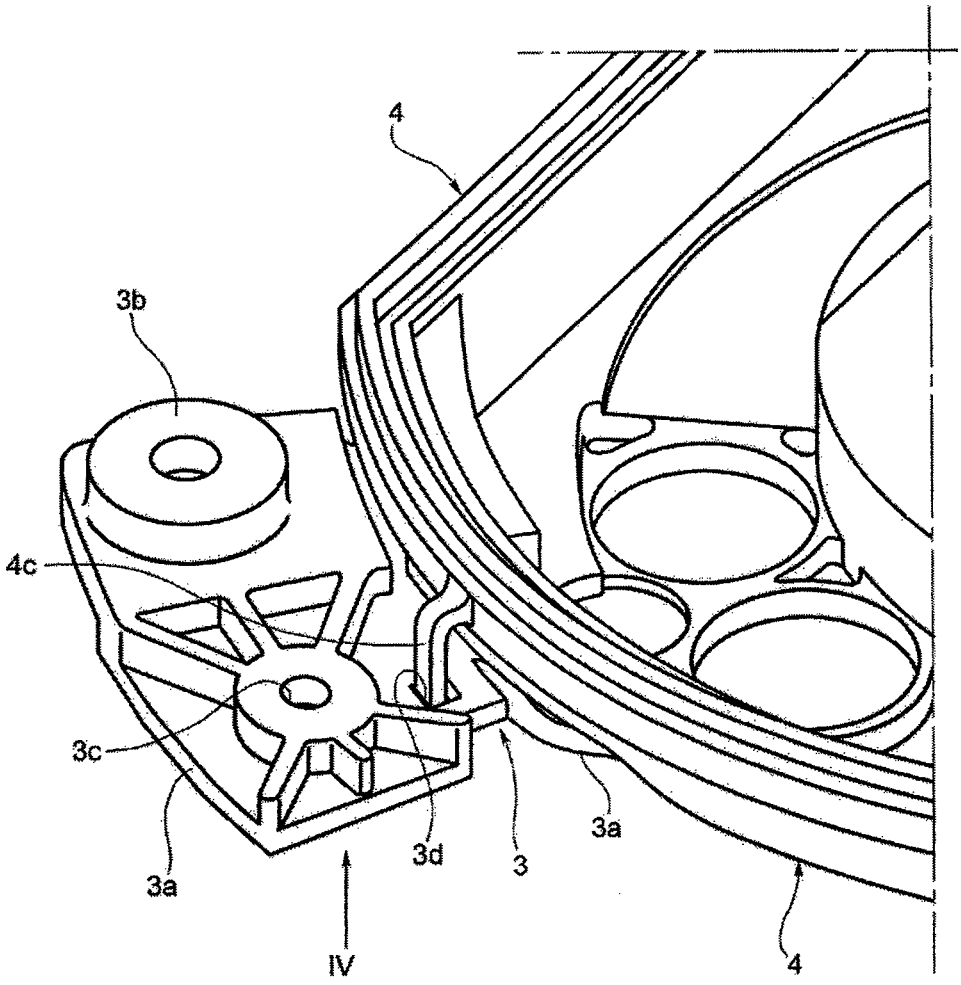
FIG. 3 is a partial view on an enlarged scale showing the method of connecting retention attachments of the casing to arms of the support.
Figure 4:
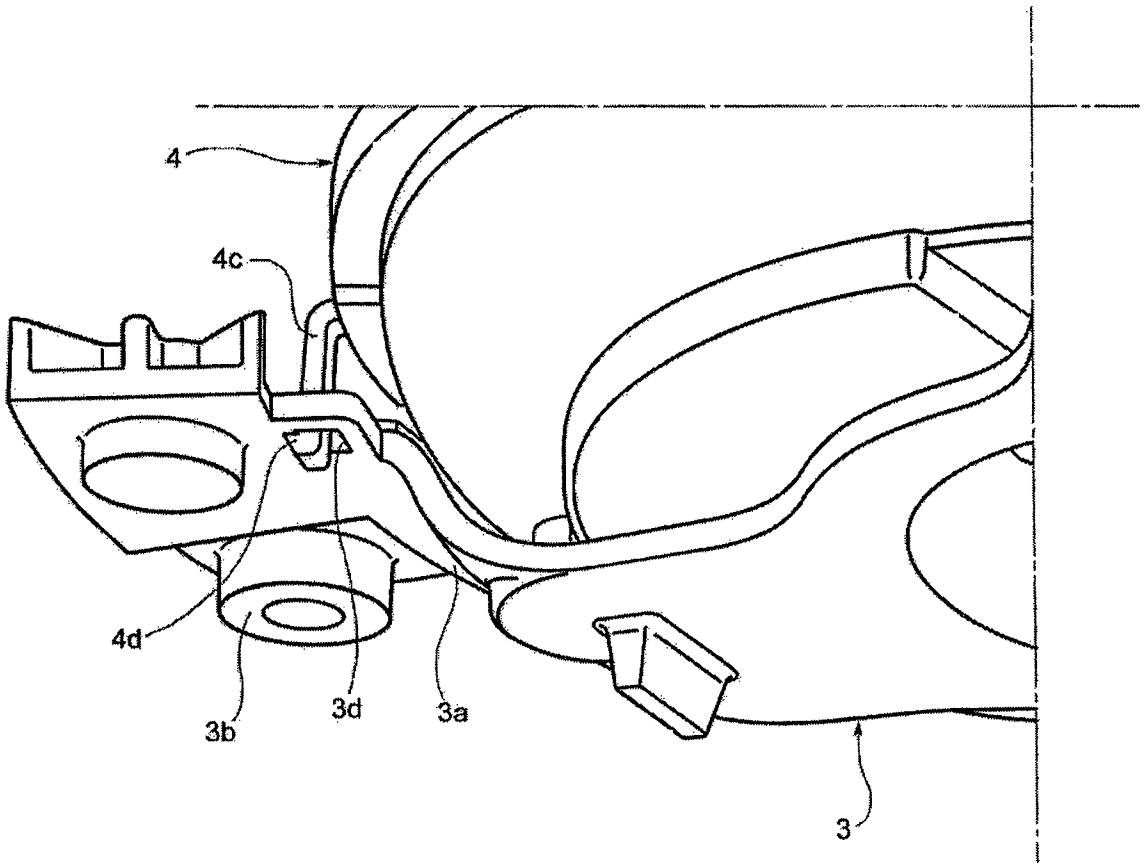
FIG. 4 is a further view of the part shown in FIG. 3, viewed from below in the direction indicated by arrow IV of FIG. 3.

With particular reference to FIGS. 1, 3 and 4, the basin-like container 4 has externally a plurality of retention attachments 4*c* which are constructed in an integral manner, i.e. as a monolithic structure, or as a single piece therewith and each retention attachment has an end retention tooth 4*d,* respectively.

The attachments 4*c* of the container 4 engage in a snap-fitting manner in the seats 3*d* of the arms 3*a* of the support 3 in order to allow a relative prepositioning of that container 4 to be brought about in relation to the support 3 before the dissipater 5 is fixed to the support.

To that end, the basin-like container 4 has, for example, three retention attachments 4*c* each for engagement with a corresponding opening or seat 3*d* of the support 3.

In the construction illustrated, the closure element or heat dissipater 5 is provided with a plurality of external fixing attachments 5*a* in the form of radially projecting, folded tabs. Those attachments are provided with through-holes 5*b*, respectively.

The fixing attachments 5*a* of the closure element or heat dissipater 5 extend into relative positions corresponding to the relative positions of the portions of the support 3 in which the threaded seats 3*c* are constructed, respectively.

Once the basin-like container 4 has been prepositioned in the support 3 by means of the engagement of the retention attachments 4*c* thereof and the circuit board 6 has been arranged at that location and connected to the terminals of the motor 2, there is positioned above the circuit board 6, a panel 9 of the so-called "gap pad" type (FIG. 1) which is intended to "fill" any spaces between the board 6 and the heat dissipater 5, improving the thermal conductivity towards the dissipater.

The heat dissipater 5 is then positioned above the basin-like container 4 and the circuit board 6 and is then fixed to the support 3 by means of screws 10 (FIG. 1) which extend through the openings 5*b* of the attachments 5*a* thereof and are screwed into the seats 3*c* of the support 3.

Advantageously, the dissipater 5 has a lateral attachment 5*c* which closes the portion 4*b* of the container 4 acting as a connector.

Figure 5:
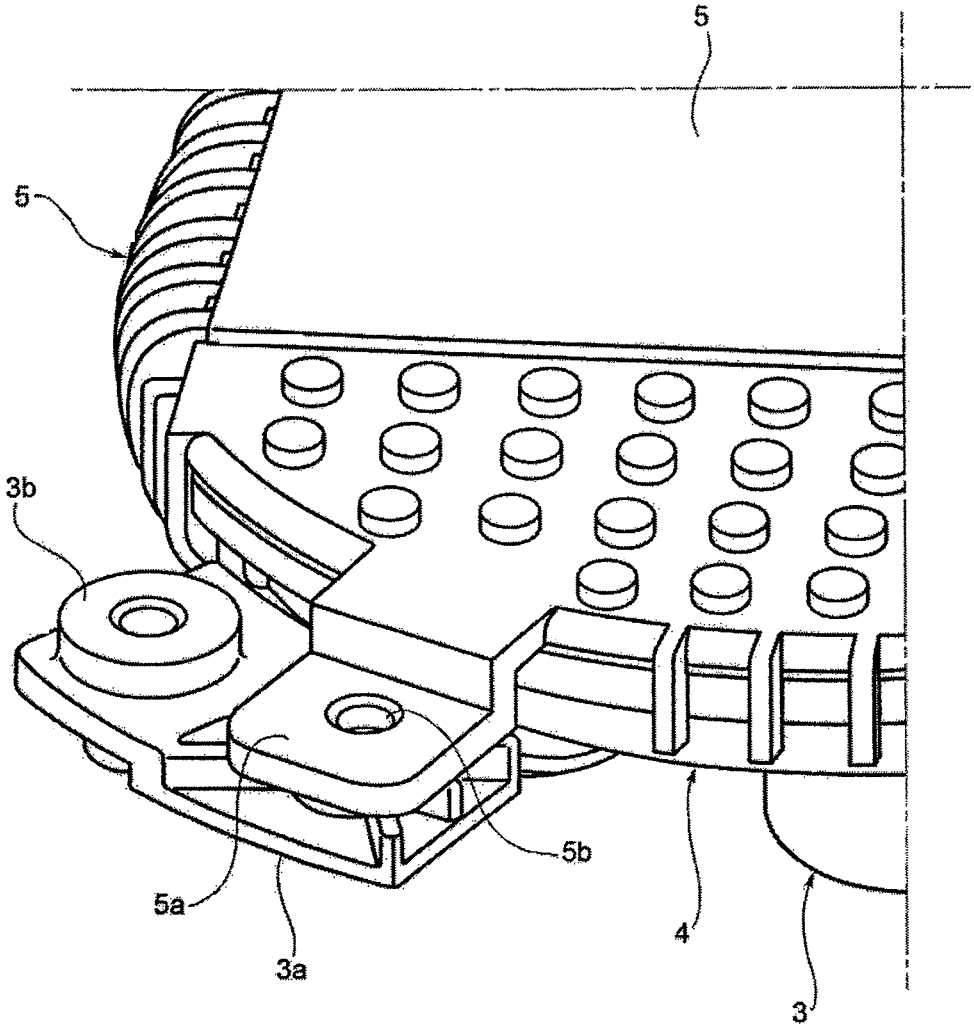
FIG. 5 is a partial view similar to FIG. 3, showing the fixing position of a dissipater supporting the motor assembly, with the casing interposed.

As may be seen by viewing FIG. 5, the fixing attachments 5*a* of the heat dissipater 5 extend in the region of and radially outwards from the retention attachments 4*c* of the basin-like member 4. The retention attachments 4*c* are therefore protected from any impacts and the integrity thereof is ensured.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A motor assembly for a fan associated with a heat exchanger of a motor vehicle, comprising:

an electric motor;

a support connected to the stator of the motor and which has a plurality of arms which project radially outwards beyond the motor for fixing to a carrier structure;

a casing which includes a basin-like container which is provided adjacent to the support at the side remote from the motor and in which at least one circuit board which carries components of a control circuit which is connected to the motor is received, and a heat dissipation member which closes the container and which has a plurality of external fixing attachments, wherein the basin-like container has a plurality of retention attachments which are engaged in a snap-fitting manner in corresponding snap seats provided in the arms of the support in order to bring about relative prepositioning of the basin-like container with respect to the support before the heat dissipater is fixed to the support.

2. The motor assembly of claim 1, wherein the basin-like container is of plastics material and the retention attachments thereof are constructed integrally with the container and each retention attachment has an end retention tooth.

3. The motor assembly of claim 1, wherein the external attachments for fixing the heat dissipater extend in the region of and towards the radially outer side of the retention attachments of the basin-like container so as to protect them.

4. The motor assembly of claim 1, wherein the support is a metal support.

5. The motor assembly of claim 1, wherein the distal end of each of the arms of the support has a boss for connection to the carrier structure, a threaded seat for mounting of the heat dissipater and a snap seat for engaging one of the retention attachments, and wherein the threaded seat and the snap seat are aligned in the radial direction with the snap seat being located radially inwards of the threaded seat.

* * * * *